US010591264B2

(12) United States Patent
Gupta et al.

(10) Patent No.: US 10,591,264 B2
(45) Date of Patent: Mar. 17, 2020

(54) HIGH STRENGTH MUNITIONS STRUCTURES WITH INHERENT CHEMICAL ENERGY

(71) Applicant: Washington State University, Pullman, WA (US)

(72) Inventors: Yogendra M Gupta, Spokane, WA (US); Atakan Peker, Spokane, WA (US)

(73) Assignee: Washington State University, Pullman, WA (US)

( * ) Notice: Subject to any disclaimer, the term of this patent is extended or adjusted under 35 U.S.C. 154(b) by 0 days.

(21) Appl. No.: 16/352,488

(22) Filed: Mar. 13, 2019

(65) Prior Publication Data

US 2020/0025540 A1 Jan. 23, 2020

Related U.S. Application Data

(63) Continuation of application No. 15/616,849, filed on Jun. 7, 2017, now Pat. No. 10,267,608, which is a continuation of application No. 15/294,516, filed on Oct. 14, 2016, now Pat. No. 9,702,676, which is a continuation of application No. 14/491,152, filed on Sep. 19, 2014, now abandoned.

(60) Provisional application No. 61/886,724, filed on Oct. 4, 2013.

(51) Int. Cl.

| | |
|---|---|
| ***B22D 27/20*** | (2006.01) |
| ***F42B 12/20*** | (2006.01) |
| ***F42B 12/74*** | (2006.01) |
| ***C22C 1/02*** | (2006.01) |

(52) U.S. Cl.
CPC ..... *F42B 12/207* (2013.01); *C22C 1/02* (2013.01); *F42B 12/74* (2013.01)

(58) Field of Classification Search
CPC ..... B22D 27/20
USPC ..... 164/55.1, 57.1
See application file for complete search history.

(56) References Cited

U.S. PATENT DOCUMENTS

| | | | | |
|---|---|---|---|---|
| 9,132,420 | B2 | 9/2015 | Nakayama et al. | |
| 9,702,676 | B1 * | 7/2017 | Gupta et al. | F42B 12/207 |
| 10,267,608 | B2 * | 4/2019 | Gupta et al. | F42B 12/207 |
| 2007/0277914 | A1 * | 12/2007 | Hugus et al. | C06B 21/005 149/19.92 |
| 2010/0024676 | A1 * | 2/2010 | Hugus et al. | C06B 33/00 102/514 |

(Continued)

OTHER PUBLICATIONS

Hartwig, et. al., "TEES Fianl Report to ARO (DARPA) on the SAM Project: High Density Amorphous Metal Matrix Composites for Kinetic Energy Penetrators", May 5, 2005, Texas Engineering Experimentation Station (TEES), pp. 1-15.

(Continued)

*Primary Examiner* — Kevin P Kerns
(74) *Attorney, Agent, or Firm* — Lee & Hayes, P.C.

(57) ABSTRACT

A process for producing a munitions structure includes combining two or more transition metals including one or more of Zr, Hf, Ti, Ta, or Nb, and one or more other elements as alloying additions. The process further includes heating and fusing together the two or more transition metals and the one or more alloying additions to form a homogenous molten alloy. The homogenous molten alloy is cooled in a metallic mold to form a solid object with a desired shape for the munitions structure.

19 Claims, 6 Drawing Sheets

(56) References Cited

U.S. PATENT DOCUMENTS

| | | | | |
|---|---|---|---|---|
| 2010/0282115 | A1* | 11/2010 | Sheridan et al. ..... | F42B 12/207 102/491 |
| 2014/0045680 | A1 | 2/2014 | Nakayama et al. | |
| 2017/0268856 | A1 | 9/2017 | Gupta et al. | |

OTHER PUBLICATIONS

Ling et al, "Spallation Behaviour of a Zr-Bulk Metallic Glass", EDP Sciences 2012, EPJ Web of Conferences 26 02003, pp. 1-6.

Office action for U.S. Appl. No. 14/491,152, dated Mar. 31, 2016, Gupta et al., "High Strength Munitions Structures With Inherent Chemical Energy", 5 pages.

Office Action for U.S. Appl. No. 15/616,849, dated Jun. 25, 2018, Gupta, "High-Strength Munitions Structures With Inherent Chemical Energy", 7 pages.

Office Action for U.S. Appl. No. 15/616,849, dated Sep. 22, 2017, Gupta, "High-Strength Munitions Structures With Inherent Chemical Energy" 5 pages.

Walters, et. al., "Investigation of a bulk metallic glass as a shaped charge liner material"; Army Research Laboratory, Aug. 2006 (Year: 2006).

* cited by examiner

HIGH STRENGTH MUNITIONS STRUCTURES WITH INHERENT CHEMICAL ENERGY

CROSS REFERENCE TO RELATED APPLICATIONS

This application is a continuation of, and claims priority to, U.S. application Ser. No. 15/616,849, filed Jun. 7, 2017, now issued as U.S. Pat. No. 10,267,608, which is a continuation of, and claims priority to, U.S. application Ser. No. 15/294,516, filed Oct. 14, 2016, now issued as U.S. Pat. No. 9,702,676, which is a continuation of, and claims priority to, U.S. application Ser. No. 14/491,152, filed Sep. 19, 2014, now abandoned, and which claims priority to U.S. Provisional Application No. 61/886,724, filed Oct. 4, 2013, the entire contents of each of the aforementioned applications being hereby incorporated by reference herein.

STATEMENT CONCERNING GOVERNMENT INTEREST

This invention was made with government support under grant no. W911NF-09-C-0033 awarded by U.S. Army Research Office. The government has certain rights in the invention.

DESCRIPTION

Field of the Invention

The invention generally relates to munitions structures. More particularly, the invention relates to munitions structures comprising a high-strength reactive alloy, and to methods of making and using articles thereof.

Background

Munitions systems (i.e. munitions) are comprised of several components including "munitions structure", a warhead (comprising conventional explosives), fuses, stability components (e.g. wings or sabot), and a propulsion unit/propellant in the case self-propelled munitions such as missiles. Warheads utilize one or both of the following general mechanisms of lethality to achieve target destruction:

i) Blast, rapid pressure increase in the ambient environment (including air and/or underwater burst) which is facilitated by the release of chemical energy of conventional explosives;

ii) Impact of a hard projectile body with a high degree of kinetic energy.

Accordingly, most warheads (excluding pure kinetic energy penetrators) incorporate a significant amount of conventional explosives to provide blast and/or to provide kinetic energy to projectile bodies. These are generally known as explosives-based warheads. In ordinary munitions systems, a warhead is the primary lethality component, that is, the primary component designed to impart damage to the target. "Munitions structure," on the other hand, is a structure with a primary function of holding together the warhead and other components of the munitions system. "Munitions structure" is typically an inert material, such as steel or brass, and is generally regarded as parasitic structure/weight with minimal or no direct lethality effect.

Munitions systems with explosives-based warheads are designed to carry a warhead to the vicinity of a target (the target vicinity) and then initiate the warhead's explosive(s)

using a fuse mechanism to create an explosion at a desired time and location. This explosion causes rapid pressure increase in the target vicinity, and the resulting blast imparts damage to the target. There are several issues for munitions systems using conventional explosives as the primary means of lethality. These include but are not limited to:

i) Addressing the high sensitivity of explosives to uncontrolled environmental effects such as heat, vibration, and impact;

ii) Launching a munitions system, specifically a warhead containing an explosive, without initiating the explosive;

iii) Initiating an explosive at an appropriate time and location in a target vicinity, iv) Passing an explosive through and into a protected target without damaging the explosive and/or causing premature explosion.

In order to address these issues, explosives-based munitions systems, and particularly warheads thereof, are typically encased with one or more structural materials (e.g. high strength steels) which protect the explosive and generally form part of the munitions structure. This configuration has the significant drawback that the munitions structure makes up a relatively large portion of the total weight of the munitions system in order to ensure viable protection for the explosive. As an example, it is not uncommon for a protective steel case to make up to 80% by weight of a given munitions system. This not only increases the overall weight of a munitions system but also complicates its transportation by air or fast moving light vehicles.

There are other complications with this conventional configuration. For example, the violent break-up of structural steel upon explosion of an explosive can cause uncontrolled fragment projectiles and collateral damage. Inertia and plastic deformation of a structural case during fragmentation also reduces the energy of explosives available for increasing ambient pressure and producing blast. This drawback requires the use of more explosives which in turn require more structural steel for protection, thus presenting undesirable limitations on the effectiveness of conventional munitions in compact packages.

Over the last two decades, a variety of reactive materials (RMs) have been developed in order to make explosive-based munitions less sensitive and require fewer explosives (i.e. less explosive material) while maintaining or improving the effectiveness of the munitions. RMs can be defined as a class of energetic solids that contain large amounts of enthalpic energy. These materials offer several advantages over traditional high explosives. These include insensitivity, lesser hazardous content, and energy output for longer times (>10 μs). Early RMs were mostly based on fluoropolymer binder metal composites such as aluminum filled with fluoropolymers. A major shortcoming of these reactive materials was the low density, which precludes them penetrating into targets. As a result, they could not be used as casing or liner material in munitions systems. These low-density materials especially lose their effectiveness on protected targets such as armored vehicles and structures.

Accordingly, fluoropolymers with high-density metals, such as tungsten (W), were developed to achieve higher density. Also, fluoropolymers with high-density reactive metals such as tantalum (Ta) and hafnium (Hf), were developed and offered improvements both in density and overall reactivity. There were also other efforts combining different reactive metals, such as Hf and aluminum (Al), with various sintering methods without fluoropolymer binders. One major issue for such hybrid materials is achieving uniform distribution of reactive metals in a matrix. The powder-based fabrication process of sintering methods results in the oxidation of reactive particles, thereby significantly reducing their energetic capacity.

Another critical shortcoming of known reactive materials is a lack of mechanical strength for structural durability. Structural components such as warhead liners are typically made of steel, a much higher strength material than reactive materials. In addition to being inadequate to serve structural purposes, known reactive materials have other deficiencies resulting from their low strength, such as the premature break-up of reactive material during launch and coupling to the target.

Accordingly, there is a need to reduce the overall content of munitions systems constituted by explosives. There is a further need to reduce the sensitivity of the explosive content while providing the desired chemical energy to produce rapid pressure increase. Furthermore, there is a need to reduce the parasitic weight of protective cases in munitions structures to increase lethality, especially in compact packages.

SUMMARY

Many advantages are achieved in munitions structures with inherent chemical energy and methods of making and using articles thereof.

A munitions structure according to the present invention comprises a high strength reactive alloy which is preferably a bulk metallic glass. Such a munitions structure may be subjected to rapid impulsive loading and fragmentation. In the presence of oxygen and/or nitrogen, resulting fragments provide for a combustion reaction which produces at least part of a blast. In some embodiments, the bulk metallic glass is Zr-based. The lethality of munitions structures is augmented by means of rapidly and simultaneously imparting both mechanical energy (kinetic energy through impact and fragmentation) and chemical energy (blast and/or fireball) to a target or target vicinity.

A munitions structure may be of virtually any size, from small to large, for use in all sizes of munitions systems, small to large. A munitions structure may be configured as a small penetrator, such as a bullet. Alternatively, a munitions structure may be part of a large penetrator or munitions system, such as a missile. Other possible configurations include but are not limited to liners and cases of munitions systems.

Methods of producing a munitions structure comprising a high strength reactive alloy, in particular a BMG, include bulk casting. During such a process, constituent metals for a reactive alloy formulation are combined and made into a homogenous molten alloy. One or more alloying additions or reinforcement materials may also be used. The homogenous molten alloy is cooled in a cast of a desired munitions structure shape at a rate sufficiently quick for the resulting (cooled/solid) metallic glass object to have a significantly amorphous/glassy phase.

BRIEF DESCRIPTION OF THE DRAWINGS

The foregoing and other objects, aspects, and advantages will be better understood from the following detailed description of preferred embodiments of the invention with reference to the drawings, in which.

DETAILED DESCRIPTION

Figure 1:
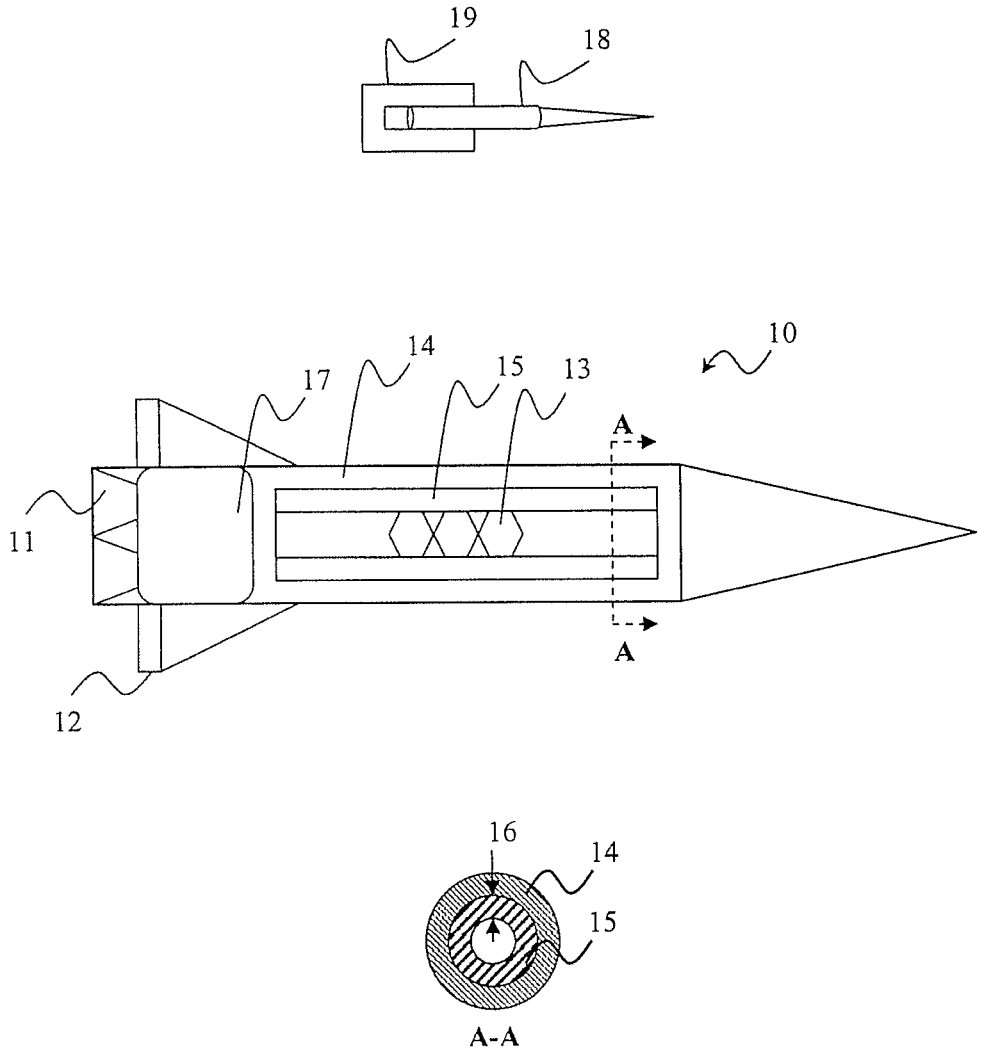
FIG. 1 shows two exemplary munitions systems (the top with a sabot and the middle with wings), each having a munitions structure comprising a high-strength reactive alloy, and also shows a cross-sectional view.

"Explosive(s)" and "high explosive(s)", as used herein, refer to conventional explosives known in the art and which traditional warheads comprise, unless otherwise noted. Examples include but are not limited to TNT, HMX and RDX.

For the purposes of this disclosure, the term "reactive alloy" refers to a metallic alloy with high affinity to oxygen and/or nitrogen. Preferably, a reactive alloy according to the invention is primarily comprised of early transition metals with high affinity to oxygen such that oxide-free surfaces readily react and combust with oxygen (e.g. ambient oxygen). Examples include but are not limited to Zirconium (Zr), Hafnium (Hf), Titanium (Ti) and Niobium (Nb). Furthermore, a reactive alloy has enthalpy of oxidation at least 1,400 calories per gram of alloy; preferably at least 1,800 calories per gram of alloy; and most preferably at least 2,000 calories per gram of alloy. Enthalpy of oxidation of a reactive alloy is defined as the weighted average of the oxidation enthalpies of the alloy's constituent metals.

For the purposes of this disclosure, the term "high-strength reactive alloy" refers to a metallic alloy having a yield strength of at least 120 kilopounds per square inch (ksi). Furthermore, a high-strength reactive alloy of the current invention has an elastic strain limit of at least 1.2%. Preferably, a high-strength reactive alloy has yield strength of at least 160 ksi and elastic strain limit of at least 1.5%. Most preferably, a high-strength reactive alloy has yield strength of at least 200 ksi and an elastic strain limit of at least 1.8%. A high-strength reactive alloy of the current invention has a density of at least 5.0 grams per cubic centimeter (g/cc), preferably a density of at least 6.5 g/cc, and most preferably a density in the range of 7.0 to 8.0 g/cc.

In short, a high-strength reactive alloy of the current invention has the following attributes: Yield strength of at least 120 ksi, elastic strain limit of at least 1.2%, enthalpy of oxidation of at least 1,400 calories per gram of alloy (defined as the weighted average of oxidation enthalpies of the constituent metals), and density of at least 5.0 g/cc. Preferably, a high-strength reactive alloy has the following attributes: Yield strength of at least 160 ksi, elastic strain limit of at least 1.5%, enthalpy of oxidation of at least 1,800 calories per gram of alloy, and density of at least 6.5 g/cc. Most preferably, a high-strength reactive alloy has the following attributes: Yield strength of at least 200 ksi, elastic strain limit of at least 1.8%, enthalpy of oxidation at least 2,000 calories per gram of alloy, and density in the range of 7.0 to 8.0 g/cc.

In some embodiments, enthalpy of oxidation may be quantified in terms of calories per cubic centimeter (cc). A high-strength reactive alloy as taught herein has an enthalpy of oxidation of at least 12,000 calories per cc of alloy;

preferably at least 15,000 calories per cc of alloy; and most preferably at least 18,000 calories per cc of alloy. Table 1 lists the enthalpies of oxidation for some preferred metals which may be used as constituent metals in a high-strength reactive alloy according to the invention. Table 2 lists the chemical formulations of four exemplary reactive alloys of the current invention. The alloy formulations provided, unless otherwise noted, are given in atomic percentages, and the ratios are based on these atomic percentages. For these four reactive alloys, Table 3 lists various properties and enthalpies of oxidation, which for each reactive alloy is determined by calculating the weighted average of the oxidation enthalpies of the constituent metals as provided in Table 1.

TABLE 1

Oxidation enthalpies of pure metals.

| Metal/Oxide | AH of oxide (kcal/g) | AH per g of metal (kcal/g) | Density (g/cc) | AH per cc of metal (kcal/cc) |
|---|---|---|---|---|
| Hf/Hf02 | 1.29 | 1.52 | 13.1 | 20.0 |
| Zr/Zr02 | 2.13 | 2.87 | 6.5 | 18.7 |
| Nb/Nb02 | 1.51 | 2.03 | 8 | 16.3 |
| Ti/TiO2 | 2.81 | 4.69 | 4.5 | 21.1 |
| Al/Al203 | 3.92 | 7.40 | 2.7 | 20.0 |
| Ta/Ta205 | 1.10 | 1.34 | 16.6 | 22.3 |

TABLE 2

Chemical formulations (using atomic percentages) of exemplary reactive bulk metallic glasses.

| Alloy Code | Zr | Hf | Nb | Cu | Ni | Al | Fe |
|---|---|---|---|---|---|---|---|
| HA-001 | 43.0 | 14.0 | 5.0 | 15.4 | 12.6 | 10.0 | — |
| HA-002 | 48.0 | 16.0 | 3.0 | 14.0 | 10.0 | 9.0 | — |
| HA-003 | 50.0 | 10.0 | 3.0 | 22.0 | — | 10.0 | 5.0 |
| HA-004 | 57.0 | — | 5.0 | 15.5 | 12.5 | 10.0 | — |

TABLE 3

Exemplary reactive bulk metallic glasses and selected properties thereof.

| Alloy Code | Density | Yield Strength (ksi) | Melting Temp. (° C.) | Calculated MI (kcaUg) |
|---|---|---|---|---|
| HA-001 | 7.9 | 240 | 854 | 2.03 |
| HA-002 | 7.9 | 225 | 862 | 2.09 |
| HA-003 | 7.5 | 215 | 866 | 2.15 |
| HA-004 | 6.8 | 215 | 806 | 2.33 |

In a preferred embodiment, a munitions system, and in particular a munitions structure, comprises one or more high-strength reactive alloys. More preferably, at least one such high-strength reactive alloy is a metallic glass. Most preferably, at least one such high-strength reactive alloy is a bulk metallic glass (BMG). A munitions system, and in particular a munitions structure, may thus comprise one or more bulk metallic glasses (BMGs).

"Metallic glasses" are metallic alloys with amorphous atomic structure in the solid state and are said to have amorphous or glassy phase. They are typically formed by quenching from the liquid state to avoid nucleation and growth of crystalline phases during solidification. Conventional metallic glasses generally require cooling rates of $10^5$ K/sec or more and are correspondingly limited to thicknesses of 0.020 mm or less. This limits the possible physical configurations into which metallic glass can be formed.

"Bulk Metallic Glass (BMG)" is defined as an alloy of metallic glass which can be cast into a metallic glass object. Bulk metallic glasses, or bulk amorphous alloys, can be cooled at lower cooling rates as compared to metallic glasses, generally 500 K/sec or less, yet still substantially retain their amorphous atomic structure. As a result, BMGs may be produced in thicknesses of 1.0 mm or more. BMGs therefore offer the distinct advantage of being formable into shapes with sizes which are substantially thicker/larger than shapes formed from a conventional metallic glass. Since the 1990's several formulations of BMGs have been developed with low critical cooling rates. U.S. Pat. Nos. 5,288,344; 5,368,659; 5,618,359; and 5,735,975, the disclosures of which are incorporated herein by reference in their entirety, disclose such bulk metallic glasses (BMGs) which may be used in accordance with the present invention.

In general, crystalline precipitates in BMGs can be detrimental to their properties, especially to toughness and strength. As a result, it is generally preferred to minimize the volume fraction of these precipitates. However, there are cases in which ductile crystalline phases, precipitated in-situ during the processing of bulk metallic glasses, are in fact beneficial to the properties of BMGs, toughness and ductility being two such properties. BMGs comprising such beneficial precipitates may also be used in the practice of the invention. Cast reactive alloys may be heat treated to provide precipitation of fine crystallites in the scale of from a few nanometers to a few micrometers and at varying volume fractions.

A "metallic glass object", unless otherwise noted, is defined as having at least 70% amorphous phase by volume. Preferably, a metallic glass object has at least 95% amorphous phase by volume. These measures apply equally to "articles of bulk metallic glass" as used herein.

Figures 2A, 2B:
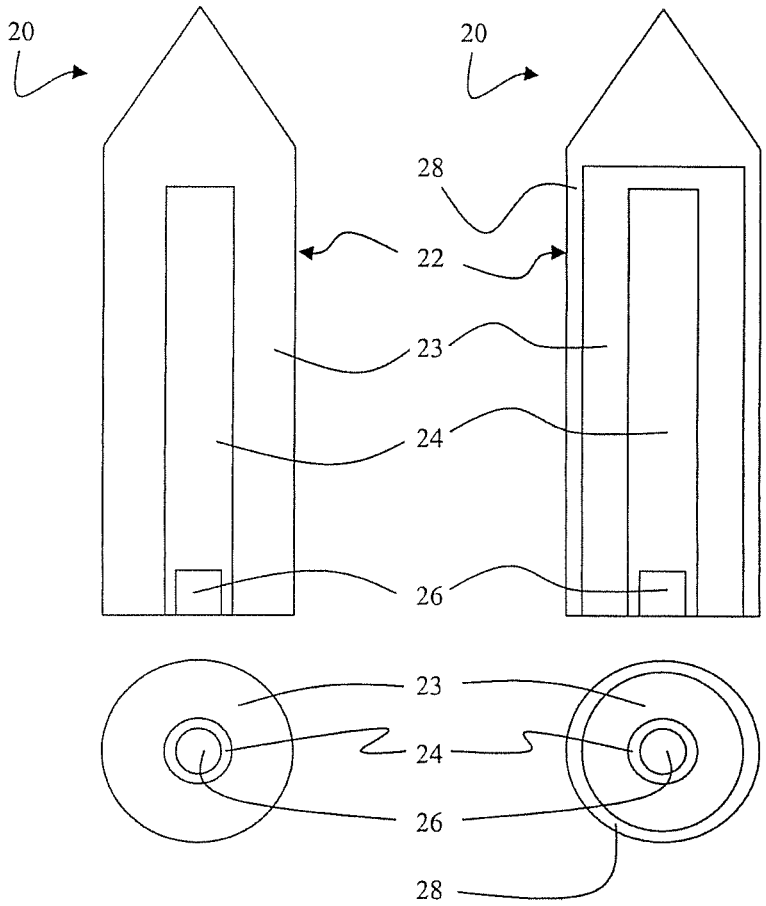
FIGS. 2A and 2B illustrate exemplary munitions structures with explosives.

Referring to the drawings and more particularly FIGS. 1 and 2A-2B, munitions structures and munitions systems according to the disclosed invention may be of any size. A munitions structure may be configured for large munitions systems, such as a missile 10, as well as small munitions systems, such as a bullet 18. Munitions structures can be configured into a variety of shapes and forms as part of various munitions systems, including but not limited to small caliber bullets, kinetic energy penetrators, and massive ordnance penetrators. For example, in one embodiment of the invention, a munitions structure is configured into a bullet 18 of .50 caliber or smaller. Penetrators are designed to pass through and into a target, useful in scenarios in which a target is armored or shielded.

In a missile 10, a munitions system may comprise one or more fuses 13, one or more stability components (e.g. wings 12 or sabot 19) and a munitions structure 15 comprising a high-strength reactive alloy. A missile 10 may be encased with a shell or body 14 comprising a high strength steel or other structural material. In the example embodiment shown, missile 10 further comprises a propulsion unit 11 supplied by a propellant vessel 17 for the self-propulsion of the munitions system.

The munitions structure 15 of missile 10 is configured as a protective case (or liner) 15. A BMG case or liner can provide multiple advantages, including 1) enabling or improving penetration through one or more protective targets and 2) producing blast upon on-demand applied stimulus/stimuli. The thickness 16 of a liner 15 may be selected according to desired blast and other characteristics of a munitions system. In a preferred embodiment where the munitions structure comprises a Zr-based bulk metallic glass, as discussed in greater detail below, liner thickness 16 is preferably less than 20 mm and more than 1 mm, and more preferably, less than 10 mm and more than 3 mm. The configuration of reactive bulk metallic glasses into munitions structures provides increased lethality (for both large and small penetrators) by rapidly and simultaneously imparting mechanical energy (kinetic energy through impact, penetration, and fragmentation) and chemical energy (blast and/or fireball to a target).

Referring to FIGS. 2A-2B, a munitions structure 20 has an axially symmetric shape and comprises a casing 22. The casing 22 includes a high strength reactive alloy 23 and is filled with explosives 24. Examples of explosives which may be used in such a munitions structure include but are not limited to TNT, HMX and RDX. In the embodiments shown, explosives 24 are fitted with one or more fuses 26. A casing 22 may also have other structural materials such as high strength steel 28 as in FIG. 2B, maraging steel, and aluminum alloys. A munitions structure 20 with or without explosives 24 may be used, for example, as a warhead in a munitions system.

High-strength reactive alloys of the invention may substitute at least in part one or both explosives and inert structural materials in conventional warheads to improve the performance and also to reduce parasitic weight in munitions structures and munitions systems.

A munitions structure 20 comprising a high-strength reactive alloy 23 may be fragmented by rapid impulsive loading. As described in detail below, the resulting fragments of the high-strength reactive alloy 23 initiate a combustion reaction with ambient atmosphere and produce rapid pressure increase facilitated by enthalpic energy of the combustion reaction. Given this and other attributes as detailed below, a munitions structure 20 provides the advantages of a significantly reduced amount of explosives and a significantly reduced amount of inert structural material in munitions systems. In FIG. 2B, for example, the thickness and total volume of the protective exterior casing of high-strength steel 28 can be significantly reduced as compared to inert structural material casings in conventional munitions structures. In some embodiments, inert structural material such as high-strength steel 40 can be eliminated entirely, such as in the embodiment shown in FIG. 2A. Were a casing 22 not to comprise a high strength reactive alloy 23, such an elimination of inert structural material would not be possible due to factors such as sensitivity of the less-protected explosives 24. Reduction and, more preferably, the elimination of inert structural material such as high-strength steel 40 results in improved performance of the munitions structure 20 and reduced parasitic weight of the structural case in munitions systems, both in large and small caliber munitions. Referring again to FIG. 1, in a missile 10 a munitions structure 15 comprising a high strength reactive alloy may replace explosives and casing 14 entirely, thereby reducing parasitic waste and providing greater insensitivity to the munitions system as a whole. Improved insensitivity furthermore allows missile 10 to be launched by a propulsion unit 11 generally not possible for munitions with conventional explosives, for example an electromagnetic propulsion based propulsion unit.

In a preferred embodiment of the invention, a reactive bulk metallic glass is a Zr-based bulk metallic glass (BMG). Zr-based BMG is defined as a metallic alloy with Zr content being more than 35 atomic percent. Broadly described, Zr-based BMGs comprise Zr and two or more elements from the group of (Cu, Ni, Fe, Co, Hf, Nb, Ta, Ti, and Al). A variety of other elements can be added, or substituted, into the latter group of elements. These additional elements include Mo, Y, V, Cr, Sc, Be, Si, B, Zn, Pd, Ag, and Sn, and may be added in modest amounts, and preferably at 3 atomic percent or less. Preferably, a reactive Zr-based BMG is quaternary (four components) or a higher order alloy system, wherein the Zr-based BMG comprises at least one element from the group of (Hf, Ti, Nb, Ta), at least one element from the group of (Cu, Ni, Fe, Co), and Al. More preferably, a reactive Zr-based BMG is quinary (five components) or a higher order alloy system, wherein each of at least three components is 5 atomic percent or more. Most preferably, a reactive Zr-based BMG is six component or a higher order alloy system, wherein each of at least four components is 5 atomic percent or more.

Zr-based BMG reactive alloys can be broadly described by the following formula:

$$Zr_aHf_b(Ta,Nb,Ti)_cCu_d(Ni,Fe,Co)_eAl_f.$$

In the above formula, a is in the range of from 30 to 60, b is in the range of from 0 to 20, c is in the range of from 0 to 8, d is in the range of from 0 to 40, e is in the range of from 0 to 30, and f is in the range of from 5 to 25. Preferably, a is in the range of from 35 to 55, b is in the range of from 0 to 20, c is in the range of from 0 to 6, d is in the range of from 5 to 40, e is in the range of from 0 to 20, and f is in the range of from 7 to 15. Still more preferably, a is in the range of from 40 to 55, b is in the range of from 0 to 14, c is in the range of from 2 to 5, d is in the range of from 10 to 35, e is in the range of from 5 to 20, and f is in the range of from 8 to 11. In another embodiment of the invention per the above given formula, a+b is in the range of from 40 to 70, and d+e is in the range of from 10 to 50. In a still more preferred embodiment of the invention per the above given formula, a+b+c is in the range of from 50 to 65 and d+e is in the range of from 20 to 40. In some embodiments, a variety of other elements can also be added to alloys of the above given formula. These additional elements include Mo, Y, V, Cr, Sc, Be, Si, B, Zn, Pd, Ag, and Sn, and may be added at 3 atomic percent or less in total, and preferably at 1 atomic percent or less in total.

In another embodiment of the invention per the above given formula, the ratio of (a+b+c) to (d+e) is in the range of from 1.2 to 2.5. In still another embodiment per the above given formula, Zr-based bulk metallic glass comprises one or more of (Ti and Nb), wherein the ratio of (Zr+Hf)/(Ti+Nb) is in the range of from 10 to 20.

In still another aspect of the invention per the above given formula, Zr-based bulk metallic glass comprises Hf and one or more of (Ti and Nb), wherein the ratio of Hf/(Ti+Nb) is in the range of from 2 to 5. In a preferred embodiment of the invention, the ratio of Hf/(Ti+Nb) is in the range of from 3 to 4. In still another preferred embodiment of the invention, Zr-based bulk metallic glass comprises Hf and Nb, wherein the ratio of Hf/Nb is in the range of from 2 to 5.

The amorphous atomic structure (glassy phase) of Zr-based BMGs provides very high yield strength and high elastic strain limit. For example, Zr-based BMGs as described above typically have yield strength of at least 180 ksi and an elastic strain limit of at least 1.6%. Given the constituent metals, such alloys according to the invention also have enthalpy of oxidation (defined as the weighted average of oxidation enthalpies of the constituent metals) of at least 1,800 calories per gram of alloy, and density in the range of 6.0 to 8.5 g/cc. Preferably, Zr-based BMGs have yield strength of at least 200 ksi, elastic strain limit of at least 1.8%, enthalpy of oxidation of at least 2,000 calories per gram of alloy, and density in the range of 6.5 to 8.0 g/cc.

Preferred formulations and selected properties of Zr-based BMGs for warheads and munitions systems according to the invention are listed in Tables 2 and 3.

The incorporation of a high-strength reactive alloy, in particular a BMG, into a munitions structure of a munitions system as taught herein may achieve one or more of the following advantages over conventional munitions structures/systems:

i. the overall explosives content and sensitivity of a munitions system is significantly less while the system's penetration and blast generation characteristics are generally maintained the same;

ii. one or both of penetration and blast generation characteristics of a munitions system is significantly better (such characteristics are significantly superior to those of a comparable conventional munitions system);

iii. the overall weight of a munitions system is significantly less and/or a munitions system is configurable into a more compact packaging while preserving or improving penetration and blast generation characteristics (that is, without resulting in inferior penetration and blast generation characteristics as compared to a comparable conventional munitions system).

The use of high-strength reactive alloys, and particularly reactive BMGs, in a munitions structure of the present invention allows for munitions systems which are much improved over conventional munitions systems using high explosives and inert structural cases which do not include high-strength reactive alloys.

Disclosed is the novel discovery that high-strength reactive alloys, in particular BMGs, as taught herein can produce significant blast, rapid pressure increase in ambient environment, and as a result allow for significant reduction or elimination of a need for high explosives used for blast generation in conventional munitions systems. Such high-strength reactive alloys in their bulk solid forms are practically inert under normal operating conditions (ambient temperature and atmosphere). However, these reactive alloys possess significant intrinsic chemical (enthalpic) energy of up to 2,000 calories per gram of alloy and, in the case of some reactive alloys, even more. The invention teaches the novel use of such intrinsic energy for producing at least part of the blast of a munitions system. This chemical energy can be discharged through a combustion reaction with ambient air, in particular oxygen and/or nitrogen. The combustion reaction may be activated under certain circumstances and by an on-demand applied stimuli.

Figure 3:
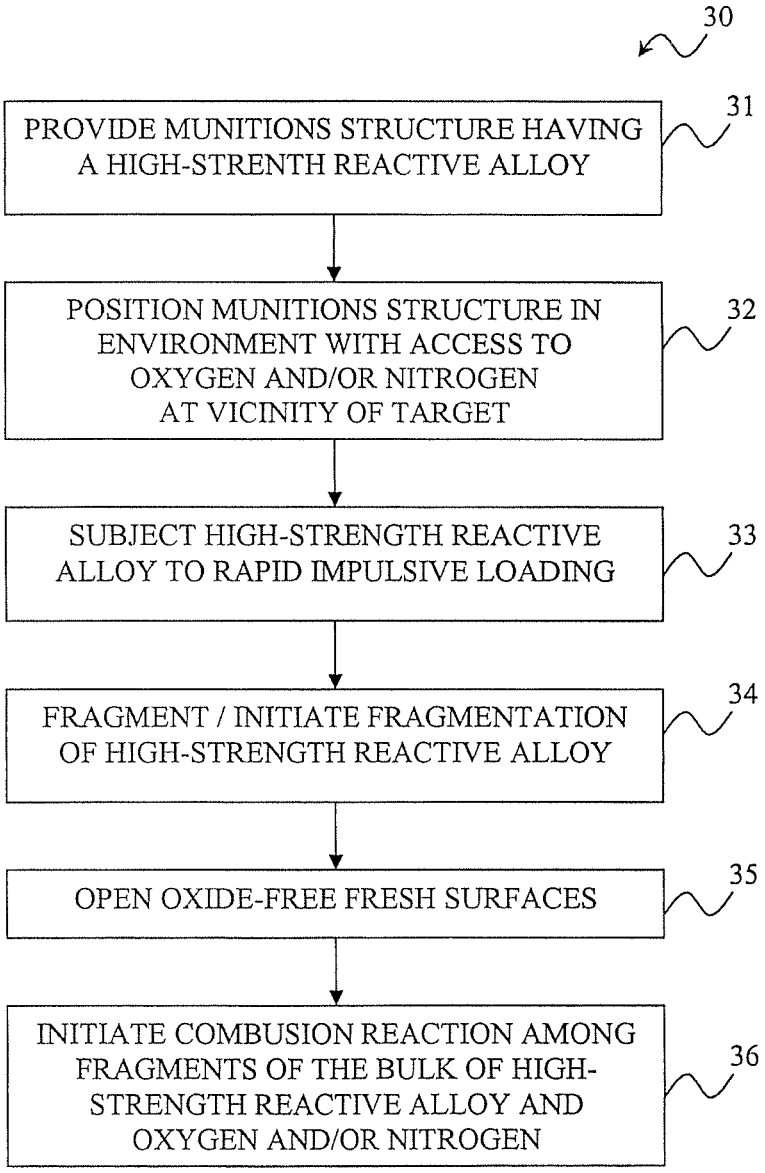
FIG. 3 presents and exemplary process for producing blast and rapid pressure increase in an environment.

Referring now to FIG. 3, a process 30 for producing blast and rapid pressure increase in an environment generally comprises the steps of:

i) Positioning a munitions structure having a high-strength reactive alloy in an environment with access to oxygen and/or nitrogen (step 32), ii) Fragmenting the high-strength reactive alloy by subjection to rapid impulsive loading (steps 33 and 34).

On the same token, process 30 may be used for initiating a combustion reaction of a high-strength reactive alloy in a munitions structure/munitions system. Particularly, process 30 for producing blast and rapid pressure increase comprises the steps or a subset of the steps of:

i) Providing (e.g. producing, supplying, etc) a munitions structure comprising a high-strength reactive alloy (of bulk solid form) (step 31), ii) Positioning the munitions structure having the high-strength reactive alloy of bulk solid form in an environment with access to oxygen and/or nitrogen (step 32), iii) Subjecting the high-strength reactive alloy to rapid impulsive loading, preferably a high-strain rate loading condition with strain rates over $10^4$/second (step 33), iv) Initiating fragmentation of the high-strength reactive alloy (step 34) and opening oxide-free fresh surfaces from the bulk solid form (step 35), and v) Initiating a combustion reaction among fragments from the fragmentation and oxygen and/or nitrogen in the environment (step 36).

One or more resulting fragments of the high-strength reactive alloy starts a combustion reaction with the available oxygen/nitrogen. The intrinsic chemical energy of high-strength reactive alloy is discharged via the combustion reaction into the environment, producing rapid pressure increase and blast. This pressure increase may also be associated with a fireball and a high temperature rise in the environment, thereby providing further lethality.

Reactive alloys as taught herein have a unique ability to sustain large mechanical strains without significant deformation given their high strength and high elastic strain limit. As such, a munitions structure of the current invention can store substantial mechanical energy during initial stages of rapid impulsive loading. Once fragmentation of a high-strength reactive alloy starts, such stored mechanical energy facilitates the formation of a finer and more uniform fragment distribution as compared with the fragment distribution of known reactive materials used in conventional munitions systems. Stored mechanical energy from initial stages of rapid impulsive loading preceding and/or concomitant with the initiation of fragmentation opens a large amount of free surfaces which are oxide free from the solid bulk form of the high-strength reactive alloy. The opening of oxide-free free surfaces from the bulk of the reactive alloy, and especially with the formation of fine and generally uniform fragments, is crucial for the prompt reaction initiation.

According to a preferred embodiment of the invention, a high-strength reactive alloy is fragmented such that 50% of the fragment distribution is less than 1,000 micron in size, and preferably 80% of the fragment distribution is less than 1,000 micron in size.

Alternatively, a high-strength reactive alloy is fragmented such that 50% of fragment distribution is less than 200 micron in size, and preferably 80% of fragment distribution is less than 200 micron in size.

Rapid impulsive loading, more particularly the forces involved therewith, can be provided by one or more of several means, including but not limited to: electromagnetic force, mechanical impact force, and blast forces from explosion of high explosives. Examples of explosives to provide rapid impulsive loading are TNT, HMX and RDX. One of skill in the art will recognize that different rapid impulsive loading means may provide different characteristics to the fragment distribution, in particular the size of the particles of the fragment distribution.

As a result of the superior fragmentation of high-strength reactive alloys as compared to conventional reactive materials, activation energy for a combustion reaction in a munitions system is substantially reduced and accordingly a substantial amount of intrinsic chemical energy can be discharged to the target and target environment. In the case of the prior art, conventional reactive materials are typically produced by compaction or sintering of powders and as such native surface oxide layers of powders remain in the particle boundaries, for example aluminum oxide on aluminum particles. Such an oxide layer hinders the reaction initiation in such materials, reduces the amount of chemical energy released and ultimately diminishes the effectiveness of prior art materials for the purposes of pressure increase and blast generation.

One particular improvement of the current invention over conventional explosives-based munitions systems is an expanded timeline of rapid pressure increase. Since the intrinsic chemical energy of a high-strength reactive alloy is released through a combustion reaction, i.e. oxidation of metals (a diffusion controlled chemical reaction), a resulting pressure increase and blast can be sustained over a longer time period, typically 200 to 20,000 microseconds. In one embodiment of the invention, the formulation of reactive alloy, the architecture of the munitions structure, and the rapid impulsive loading can be configured such that a relatively finer fragment distribution is generated to achieve a blast effect for a period of from 200 to 2,000 microseconds. In another embodiment of the invention, the formulation of reactive alloy, the architecture of the munitions structure, and the rapid impulsive loading can be configured such that a relatively coarser fragment distribution is generated to achieve a blast effect for a period of from 2,000 to 20,000 microseconds. This provides a more effective pressure increase and lethality against large structures, such as buildings and tunnels. Conventional high explosives provide a blast with a relatively large amplitude but with very short time duration, typically 0.5 to 10 microseconds. This results in several challenges to imparting the desired damage to a target. For example, the precise timing of the explosion as well as the initiation of explosives becomes highly critical since a warhead with high explosives moves at very high speeds. If timing is not extremely precise, a high speed warhead may bypass an optimal location to provide the desired damage to the target. The comparatively longer time duration of pressure increase resulting from a combustion reaction of a high-strength reactive alloy may effectively allow the optimal location for detonation of a munitions structure to be less exact (i.e. the optimal location is a larger region of space), thereby allowing more flexibility in detonation timing and/or room for error without a reduction in the desired damage to the target.

Reactive alloys as taught herein have yield strength values up to 200 ksi or more, meeting or exceeding strength levels of conventional "premium" inert structural materials. This provides several advantages:

i) A high-strength reactive alloy can reduce or eliminate the need for/use of inert structural materials, such as high strength steel, normally required to protect explosive contents of a warhead. This provides for novel warheads in more compact packages but with similar or better blast generation characteristics as compared with conventional warheads.

ii) Warheads comprising high-strength reactive alloy can be launched at significantly higher velocities than conventional explosives-based warheads of similar blast capacity.

In preferred embodiments of the invention, the ratio of the mass of the structural components of the munitions structure (the total mass of high-strength reactive alloy and other structural components comprising the munitions structure) to the mass of explosives in a munitions system (this ratio being designated as M/C) is in the range of from 1.0 to 10.0. Preferably, M/C is in the range of 1.5 to 6, and most preferably M/C is in the range of from 2.5 to 4.

Articles of high strength reactive alloy, in particular bulk metallic glass, may be produced and fabricated by a variety of methods. For example, reactive alloys usable in accordance with the invention, in particular BMGs, can be produced and fabricated into articles by a bulk-casting method. This is in distinct contrast to reactive materials of the prior art, which are typically produced and fabricated into articles by powder compaction or by other means of powder metallurgy.

The bulk casting method provides a relatively uniform and homogenous structure, where particles with surface oxides are minimized or eliminated. The structure/objects produced are generally metastable structures providing high strength. Basically, a bulk-casting of a reactive alloy according to the current invention is substantially free of particles with oxide boundaries. Exterior surfaces of a bulk-casting, however, may have a passivation layer for improved inertness and corrosion resistance for storage.

Figure 4:
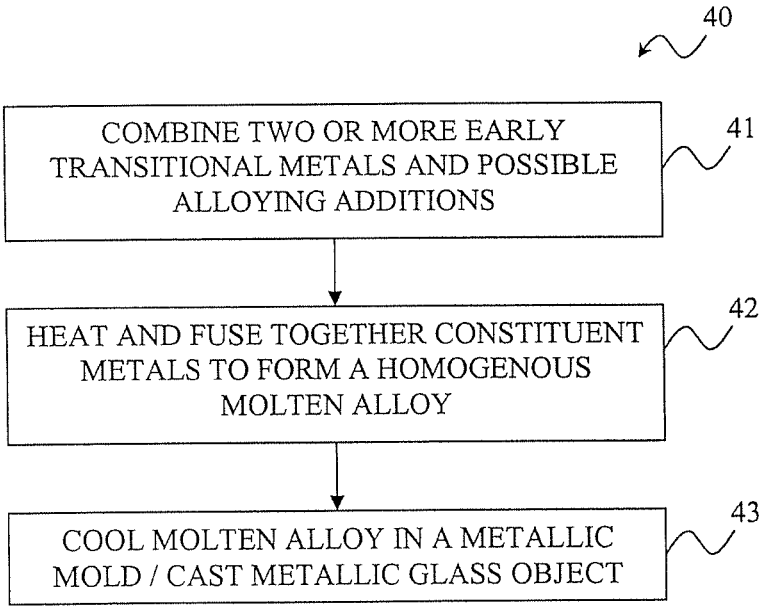
FIG. 4 presents an exemplary process for producing articles of munitions structure by bulk casting.

Referring now to FIG. 4, a process 40 for making an article of munitions structure generally comprises the following steps:

i) Combining two or more early transition metals including one or more of Zr, Hf, Ti, Ta and Nb, and one or more other elements as alloying additions, consistent with a formulation as taught in this disclosure (step 41);

ii) Heating and fusing together the constituent metals to form a homogenous molten alloy (step 42), and iii) Cooling the homogenous molten alloy in a metallic mold to form a solid object with a desired shape for a munitions structure (step 43).

A process 40 for making munitions structures is generally performed under inert atmosphere conditions (e.g. in the absence of oxygen) to avoid oxidation and to provide a clean bulk cast structure substantially free of oxygen and oxides.

Figure 5:
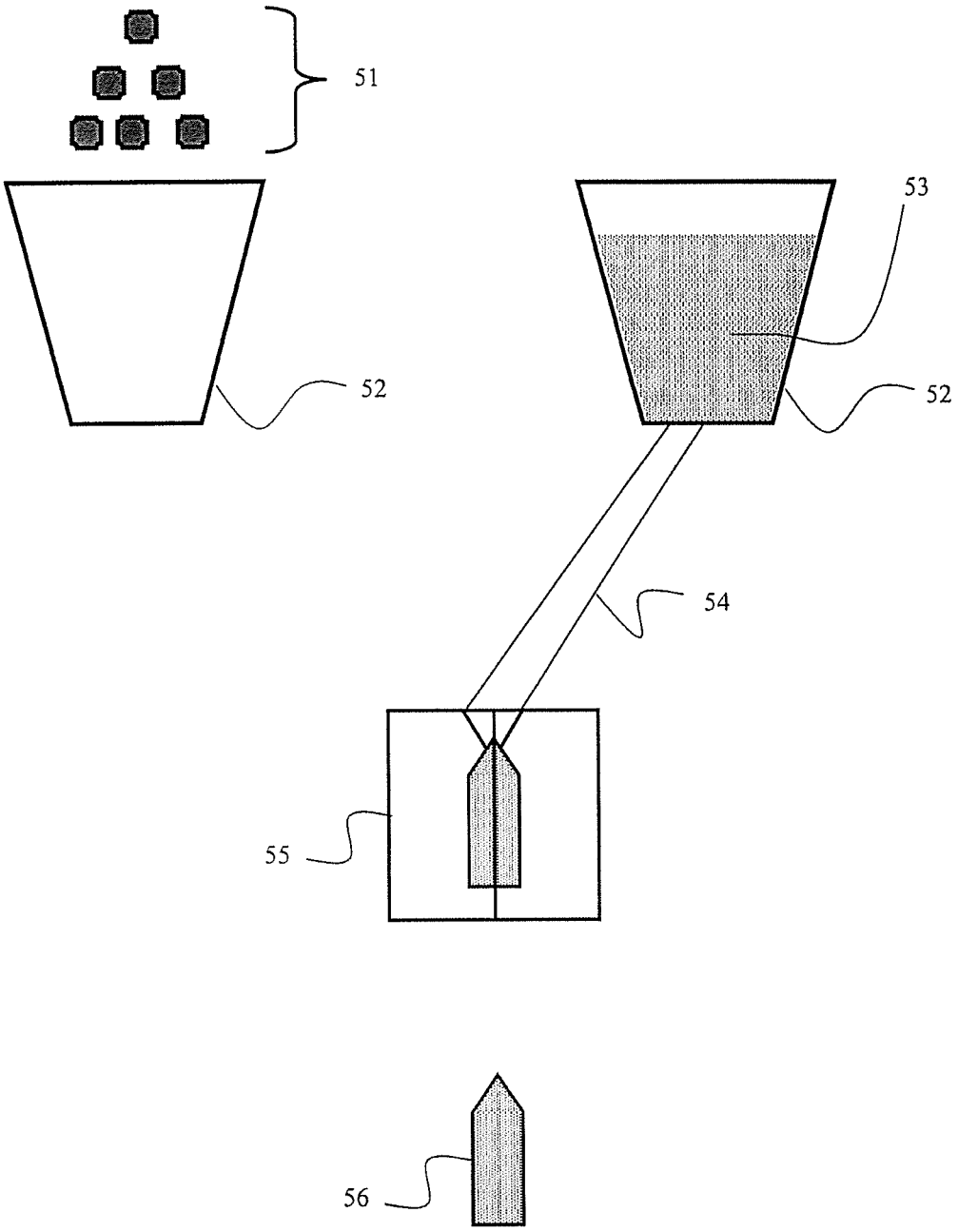
FIG. 5 is a schematic drawing for a casting process for producing articles of munitions structure.
Figure 6:
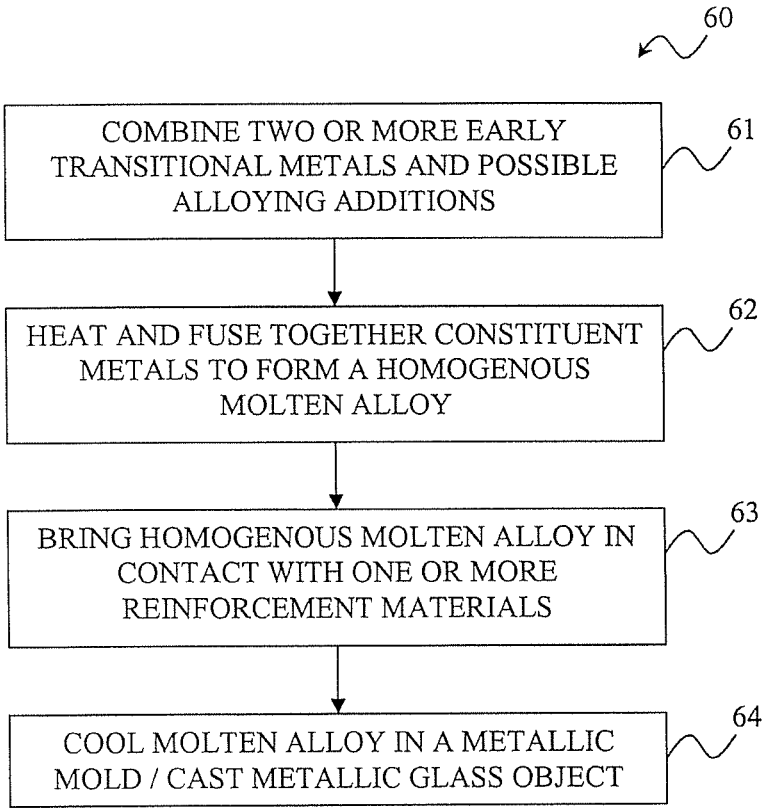
FIG. 6 presents an exemplary process for producing articles of munitions structure with one or more reinforcement materials.

Referring to FIG. 5, a casting process is shown schematically according to the current invention. Constituent metals/feedstock alloy 51 are combined, either sequentially or concomitantly, in a melting furnace 52. The melting furnace 52 is heated to a sufficient temperature to melt the constituent metals and allow for their fusion and formation of a homogenous melt 53 of high-strength reactive alloy. A melt pouring/injection mechanism 54 is configured to transfer at least a portion of homogenous melt 53 to a metallic mold 55 with a near-to-net shape cavity of a munitions structure. With such metallic mold casting, an alloy melt is generally injected into a metallic mold made of a material such as copper or steel. The mold is then cooled sufficiently quickly to inhibit and preferably prevent crystal formation within the alloy as it transitions into a solid state. Once cooled, the metallic mold 55 and a bulk-cast munitions structure 56 comprising high-strength reactive alloy separated. The bulk-cast munitions structure 56 may then be implemented in a desired munitions system.

In a preferred embodiment, the homogenous molten alloy is a Zr-based bulk metallic glass comprising Zr and two or more elements selected from the group of (Cu, Ni, Fe, Co, Hf, Nb, Ta, Ti, and Al). Cooling the homogenous molten alloy must be performed sufficiently fast such that the cooled reactive alloy has an amorphous/glassy state. Preferably, the cooled reactive alloy has at least 70% amorphous phase by volume.

A homogenous molten alloy may be cast into a metallic glass object having any desired shape of munitions structure. A preferred shape, however, into which a BMG is cast is a cylindrical rod with a diameter of 10 mm or more. However, bulk metallic glass can be cast into many shapes, and the use of the terms "cylindrical rod" and "diameter" is not intended to be limiting. One of skill in the art will recognize that the preferred diameter values taught herein correspond with preferred values for other shapes (e.g. plates or discs) for alternative embodiments. Size values, for instance cross-section size, may be calculated by using heat transfer laws and/or routine experimentation.

A Zr-based BMG in a munitions structure my have a section thickness of less than 20 mm and more than 1 mm, and more preferably, a section thickness less than 10 mm and more than 3 mm. This is applicable, for example, in a BMG liner.

In another preferred embodiment, a method 60 is provided for making a composite article of munitions structure comprising the following steps:

i) Combining Zr and two or more elements from the group of (Cu, Ni, Fe, Co, Hf, Nb, Ta, Ti, and Al) according to an alloy formulation of Zr-based bulk metallic glass as taught herein (step 61), ii) Forming a homogenous molten alloy of Zr-based bulk metallic glass by heating/fusing together the constituent metals of the preceding step (step 62), iii) Bringing the homogeneous molten alloy of Zr-based bulk metallic glass in contact with one or more reinforcement materials (e.g. selected from the group consisting of high strength steel, stainless steel, tantalum, tungsten, nickel alloy, cobalt alloy, molybdenum and niobium alloy) (step 63).

iv) Cooling the homogenous molten alloy of Zr-based bulk metallic glass (in contact with the said reinforcement material) fast enough to cast a composite object having the desired shape of munitions structure, wherein the Zr-based alloy forms amorphous phase at least 70% by volume (step 64).

According to method 60, bulk metallic glass objects/articles are produced in the presence of reinforcement materials, such as refractory metals (e.g. Ta, W, Nb, etc.) and ceramics (e.g. SiC) to form objects of hybrid and composite materials. A munitions structure may therefore comprise one or more BMGs, refractory metals, ceramics, and/or a combination of these elements. The reinforcements can be in various shapes and forms such as wires and particulates.

The above-described methods for making articles of munitions structure comprising high-strength reactive alloy provide a homogenous bulk object with minimal oxide content and without internal particle boundaries defined by oxide layers. Generally, the oxygen impurity content of a high-strength reactive alloy produced according to the invention is less than 1,000 ppm, preferably less than 500 ppm, and most preferably less than 200 ppm. The oxygen content of a high-strength reactive alloy may be adjusted and tailored according to desired strength and fracture toughness properties. Generally, a higher oxygen content reduces fracture toughness of a reactive alloy. The reduction in oxygen content in a bulk of a reactive alloy, and elimination of oxide-layer defined internal particle boundaries, provides a finer and more uniform fragmentation and prompt initiation of combustion reaction with reduced activation energy levels. Accordingly, a larger amount of inherent chemical energy can be discharged more effectively to the target and target environment as compared with conventional reactive materials.

While the invention has been described in terms of preferred embodiments and variations thereon, those skilled in the art will recognize that the invention can be practiced with modification within the spirit and scope of the appended claims.

What is claimed is:

1. A process for producing a munitions structure, the process comprising:

combining:

two or more transition metals including one or more of Zr, Hf, Ti, Ta, or Nb, and one or more other elements as alloying additions;

heating and fusing together the two or more transition metals and the one or more alloying additions to form a homogenous molten alloy; and cooling the homogenous molten alloy in a metallic mold to form a solid object with a desired shape for the munitions structure, wherein the homogenous molten alloy has a formula:

$$Zr_aHf_b(Ta,Nb,Ti)_cCu_d(Ni,Fe,Co)_eAl_f$$

such that a ranges from 40 to 60, b ranges from 0 to 14, c ranges from 2 to 5, d ranges from 10 to 35, e ranges from 5 to 20, and f ranges from 7 to 12.

2. The process of claim 1, further comprising bringing the homogeneous molten alloy in contact with one or more reinforcement materials.

3. The process of claim 1, wherein the cooling includes cooling the homogenous molten alloy at a rate of 500 K/sec or less.

4. The process of claim 1, wherein the cooling includes cooling the homogenous molten alloy to form the solid object with at least 70% amorphous phase by volume.

5. The process of claim 1, further comprising bringing the homogeneous molten alloy in contact with one or more of: refractory metals, ceramics, or a combination of refractory metals and ceramics.

6. The process of claim 1, further comprising bringing the homogeneous molten alloy in contact with one or more of: high strength steel, stainless steel, tantalum, tungsten, nickel alloy, cobalt alloy, molybdenum, or niobium alloy.

7. The process of claim 1, wherein the cooling includes cooling the homogeneous molten alloy in contact with a reinforcement material having a shape of a wire or a particulate.

8. The process of claim 1, wherein the cooling includes cooling the homogenous molten alloy to form the solid object as a high-strength reactive alloy having an oxygen impurity content of less than 1,000 ppm.

9. The process of claim 8, wherein the oxygen impurity content is less than 500 ppm.

10. The process of claim 8, wherein the oxygen impurity content is less than 200 ppm.

11. A process for producing a munitions structure, the process comprising:

combining:

Zr, and two or more elements including one or more of Cu, Ni, Fe, Co, Hf, Al, Ti, Ta, or Nb;

heating and fusing together the Zr and the two or more elements to form a homogenous molten alloy; and cooling the homogenous molten alloy to form a solid object with a desired shape for the munitions structure, wherein the homogenous molten alloy has a formula:

$$Zr_aHf_b(Ta,Nb,Ti)_cCu_d(Ni,Fe,Co)_eAl_f$$

such that a ranges from 40 to 60, b ranges from 0 to 14, c ranges from 2 to 5, d ranges from 10 to 35, e ranges from 5 to 20, and f ranges from 7 to 12.

12. The process of claim 11, wherein the solid object has a form of an amorphous phase at least 70% by volume.

13. The process of claim 11, wherein the homogenous molten alloy is a high strength reactive alloy having:

a yield strength of at least 200 ksi, an elastic strain limit of at least 1.8%, and an enthalpy of oxidation of at least 15,000 calories per cc.

14. The process of claim 11, wherein the homogenous molten alloy is substantially defined by the formula $Zr_{43}Hf_{14}Nb_5Cu_{15.4}Ni_{12.6}Al_{10}$.

15. The process of claim 11, wherein the homogenous molten alloy has the following formula:

$$Zr_aHf_b(Nb,Ti)_cCu_d(Ni,Fe)_eAl_f$$

wherein the ratio of (a+b+c) to (d+e) ranges from 1.2 to 2.5, and the ratio of (a+b) to c ranges from 10 to 20.

16. The process of claim 11, wherein the homogenous molten alloy is a bulk metallic glass.

17. The process of claim 11, wherein the homogenous molten alloy is a high strength reactive alloy having an elastic strain limit of at least 1.2% and an enthalpy of oxidation of at least 1,400 calories per gram.

18. The process of claim 11, wherein the solid object is a high strength reactive alloy without internal particle boundaries defined by oxide layers.

19. The process of claim 11, wherein the cooling includes cooling the homogeneous molten alloy in contact with a reinforcement material having a shape of a wire or a particulate.

* * * * *